US006781052B2

(12) United States Patent
Hasenauer

(10) Patent No.: US 6,781,052 B2
(45) Date of Patent: Aug. 24, 2004

(54) HIGH VOLTAGE CABLE EMI SHIELD

(75) Inventor: Charles H. Hasenauer, Rochester, NY (US)

(73) Assignee: NexPress Solutions, Inc., Rochester, NY (US)

( * ) Notice: Subject to any disclaimer, the term of this patent is extended or adjusted under 35 U.S.C. 154(b) by 0 days.

(21) Appl. No.: 10/121,721

(22) Filed: Apr. 12, 2002

(65) Prior Publication Data

US 2003/0192714 A1 Oct. 16, 2003

(51) Int. Cl.[7] ..... H01B 7/00; H01B 7/34
(52) U.S. Cl. ..... 174/29; 174/36
(58) Field of Search ..... 174/36, 27, 28, 174/29, 102 R, 102 SC, 100 C, 103, 105 R, 106 R, 110 R

(56) References Cited

U.S. PATENT DOCUMENTS 3,758,700 A * 9/1973 Ditscheid ..... 174/28
3,878,319 A * 4/1975 Wahl ..... 174/106 SC
3,935,042 A * 1/1976 Wahl ..... 156/56
4,018,977 A * 4/1977 Herrmann et al. ..... 174/24
4,086,650 A * 4/1978 Davis et al. ..... 361/229
4,145,567 A * 3/1979 Bahder et al. ..... 174/107
4,427,256 A 1/1984 Reif et al. ..... 339/143
5,597,979 A * 1/1997 Courtney et al. ..... 174/35 R
6,225,565 B1 5/2001 Prysner ..... 174/120

FOREIGN PATENT DOCUMENTS

DE 27 26 291 A1 * 12/1978 ..... H01B/9/02

* cited by examiner

*Primary Examiner*—William H. Mayo, III

(57) ABSTRACT

EMI shielding for high voltage interconnection cables in corona charging systems. The corona charger includes a high voltage conductor to transmit energy from a power supply to the corona charger. A high frequency voltage, grounded conductive shield surrounds the high voltage conductor. The grounded conductive shield is formed from a conductive fabric having at least one grounding tab formed from said conductive fabric. A foam spacer is located between the shield and the conductor.

4 Claims, 3 Drawing Sheets

HIGH VOLTAGE CABLE EMI SHIELD

FIELD OF THE INVENTION

The present invention is related to corona chargers, and more particularly, to shielding of high voltage cables between the high voltage source and the charger assembly.

BACKGROUND OF THE INVENTION

Corona chargers generate high frequency emissions that need to be suppressed by the shielding of high voltage cables. This suppression may be required for compliance with applicable electromagnetic emissions regulations and/or system functional requirements. In some applications a fully shielded solution is not required. A simple return path coaxial with the high voltage wire between the power source and the corona charger is all that is necessary. If the shield is placed close to the conductor there will be corona emissions and/or capacitive current through the high voltage wire insulation. This current loss through the insulation is typically in the range of tens to hundreds of microamps. In many electrophotographic charging applications current regulated power supplies are used to drive the charging systems. Typical current regulated chargers operate in the range of 100–2000 microamps. The loss of small amounts of current through unintended paths, such as through the shield, reduces the effectiveness of the system. Corona current flow from wire to shield reduces the efficiency of the system and degrades the insulation system resulting in lower reliability.

Electrophotographic printing machines are built in a variety of physical configurations requiring many different high voltage cable routings. It is desirable to have a shielding system that can easily be adapted to different lengths and shapes. A simple flexible shielding system that can provide a consistent minimum space between the high voltage conductors and the shield is required.

U.S. Pat. No. 3,758,700 issued to Ditscheid (hereinafter Ditscheid) describes a system for spacing the conductors of a coaxial power cable using flanges or ribs to position the inner conductor coaxially from the outer conductor. The ribs or flanges are used to position the inner conductor coaxially with respect to the outer conductor while providing adequate spacing to prevent corona discharge or arcing and providing means for heat dissipation. The teachings of Ditscheid, address high frequency and high power applications over significant lengths and employs multiple spacer components to provide the necessary spacing. Ditscheid provides a method for eliminating stiff axial insulation, which causes cables to be inflexible, by added multiple radial spacers integral to the cable and shield assembly. However, the teachings of Ditscheid do not present a simple method for adding a spaced shield to existing common low power high voltage wiring. In practice, electrophotographic imaging systems will have the location of corona chargers and their high voltage power sources vary. In some cases mounting and cabling can be done such that electromagnetic radiation is not a concern. In other applications high voltage cables require a ground return, between the power source and load, coaxial to the high voltage conductor. It is desirable to have a shielding system that can be adapted to various applications without the use of special cabling as described by Ditscheid.

U.S. Pat. No. 4,427,256 issued to Reif, et al. (hereinafter Reif) describes a system to prevent discontinuities at the terminations of a tightly spaced coaxial cable from enhancing the possibility of corona discharge between the inner conductor and the edges of the outer conductor. Reif recognizes the problems associated with termination of cable shielding in close proximity to the high voltage conductor. Reif has the shortcoming in that it does not address current loss through the corona shield on the cable. The teachings of Reif address the cable interconnects. The flow of corona and AC capacitive current from the center conductor to the shield along the length of the cable is not addressed. In low power, low current applications these losses can have a detrimental impact on the function of the system. The present invention addresses this problem within the prior art.

U.S. Pat. No. 6,225,565 issued to Prysner (hereinafter Prysner) describes a flexible conductive elastomeric material forming a Faraday shield that is used for EMI isolation. Prysner teaches the use of conductive particles within the elastomer that results in elastomeric material that shields, rather than acting as a spacer between the inner conductor and the shield. The EMI isolation technique taught by Prysner has the shortcoming of requiring numerous layers to construct and is, therefore, expensive to manufacture.

From the foregoing discussion, it should be readily apparent that there remains a need within the art for a continuous flexible spacer that can be used between high voltage conductors and shields that is capable of alleviating the problems associated with corona discharge through the insulation to the shield.

SUMMARY OF THE INVENTION

The present invention addresses the shortcomings within the prior art by providing a continuous flexible spacer between the high voltage conductor and the shield. The problems associated with corona discharge through the insulation to the shield can be eliminated while providing a low part count, and a simple to assemble package.

It is an object of the present invention to provide a simple process to create a flexible assembly by adding a spaced shield to existing common low power, high voltage wiring.

It is a further object of the present invention to eliminate loses by providing a spacer between the center conductor and the shield along the entire length of the shield, thus eliminating problems at the terminations.

The foregoing objects are provided by the invention in a corona charger with a high voltage shield having a high voltage conductor to transmit energy from the power source to the corona charger, a high frequency voltage shield surrounding the high voltage conductor, and a spacer between the shield and the conductor.

The invention disclosed provides an economical and adaptable system for providing EMI shielding on high voltage interconnection cables in corona charging systems. The shield can be implemented without loss of efficiency in the transmission of low-level currents from the power source to the charging device.

DETAILED DESCRIPTION OF THE INVENTION

The invention provides a method and apparatus for shielding high voltage cables while reducing current flow to the shield, by adding a continuous foam spacer between the high voltage conductor and the grounded conductive shield. The teachings of Ditscheid do not present a simple, flexible assembly for adding a spaced shield to existing common low power, high voltage wiring. The present invention provides a flexible assembly with a simple process for adding a spaced shield to existing common low power high voltage wiring. The present invention also eliminates loses by providing a spacer between the center conductor and the shield along the entire length of the shield, thus eliminating the problem at the termination that Reif addresses.

Figure 1:
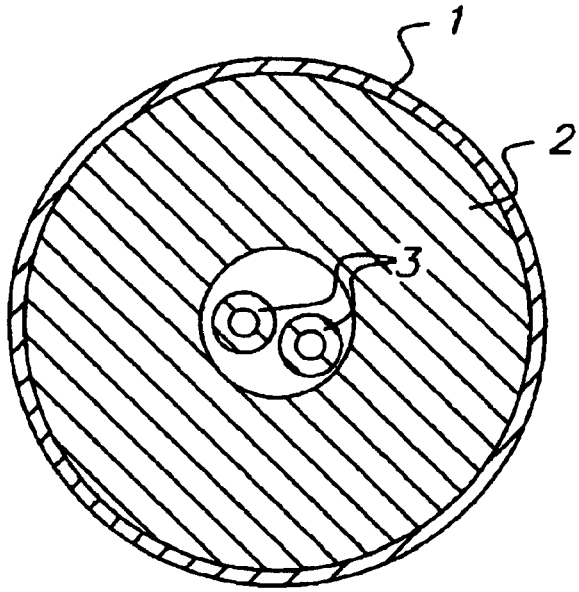
FIG. 1 is a cross sectional view of the shield, spacer and cable configuration.
Figure 2:
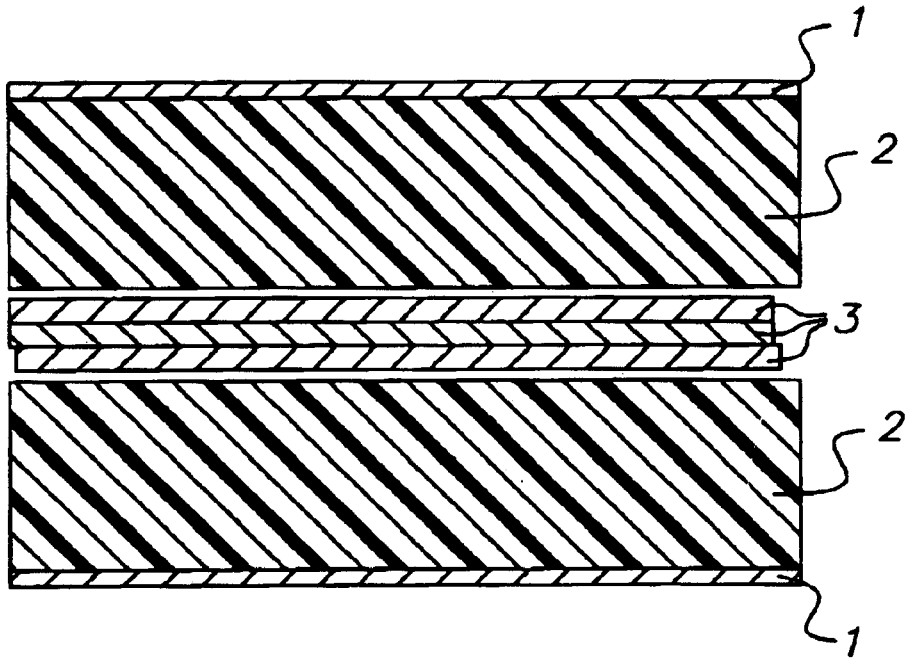
FIG. 2 is a longitudinal cross sectional view of the shield, spacer and cable configuration.

Referring to FIG. 1 in conjunction with FIG. 2, it has been discovered that problems associated with corona discharge through the insulation to the shield 1 are eliminated by the addition of a flexible spacer 2 between the insulated high voltage conductors 3 and the shield 1. FIG. 1 illustrates an axial cross sectional view for the preferred configuration of the invention. FIG. 2 is a longitudinal cross sectional view of the shield 1, spacer 2 and conductor 3 shown in FIG. 1. Preferably, an insulating foam tube is wrapped with a conductive shield 1.

Figure 3:
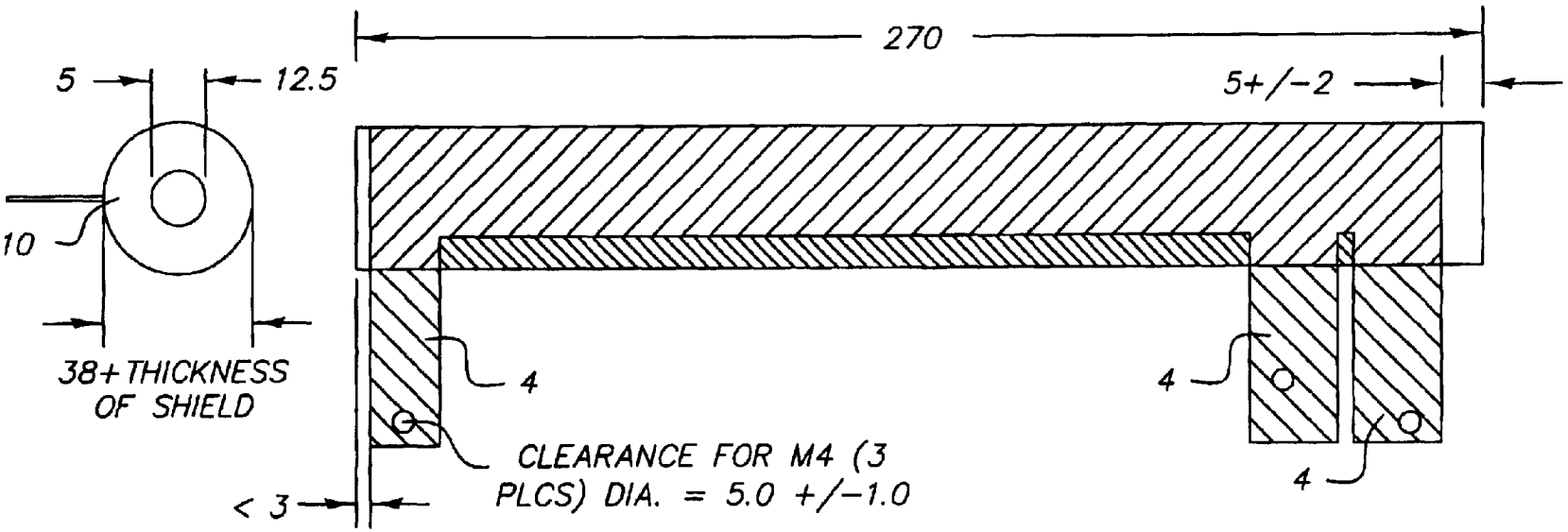
FIG. 3 is a view of the preferred embodiment of the invention showing the grounding connections of the shield.

FIG. 3 is a view of the preferred embodiment of the invention to illustrate the grounding connections employed for the shield 1. The shield 1 is grounded via the integral ground tabs 4 as shown in FIG. 3, the shaded area is the conductive shield 1 and the grounding tabs are, preferably, formed by heat-sealing the fabric. As seen in FIG. 3, the fabric used to make shield 1 is wrapped around the continuous spacer 2. In the preferred embodiment, shield 1 is made from a Schlegel® Silver $C^2$ fabric, although numerous types of conductive fabric can be used for shield 1. The shield 1 is preferably grounded at both ends. One end of the shield is connected to the power supply case ground. The other end of the shield is connected to the ground reference surface of the corona charger.

Figure 4:
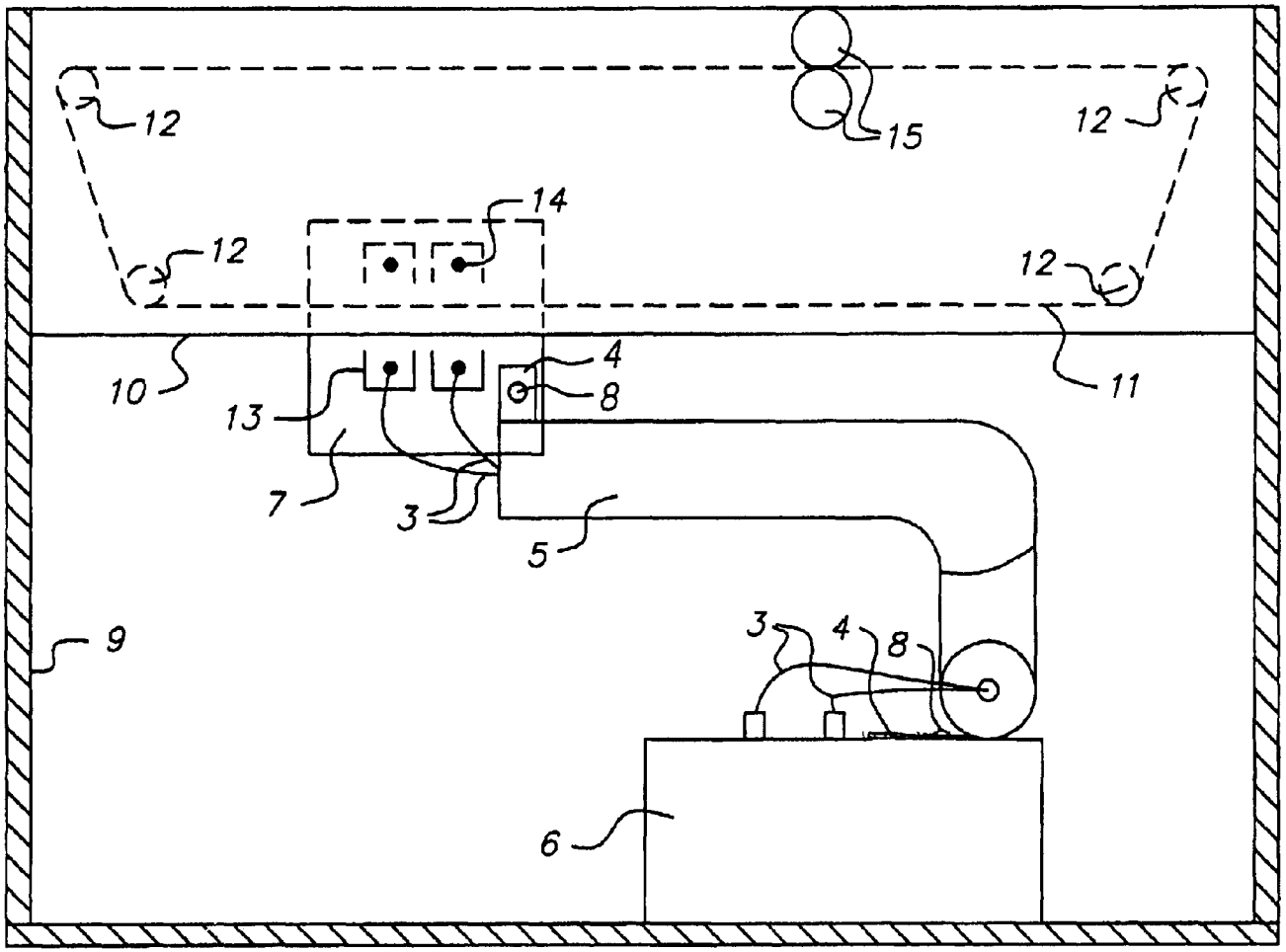
FIG. 4 is a view of the shield in relation to the charger assembly and power supply.

FIG. 4 shows the relationship of the shield and spacer assembly 5, power supply 6 and corona charger assembly 7 within a simple structure. A grounded frame 9 is shown with the grounded metal case of power supply 6 and the grounded metal web transport frame attached to it. The web transport frame contains four rollers 12 which comprises a drive and idler roller system, which drives an insulating belt through two separate charging devices. A DC roller charger 15 applies electrostatic charge to the insulating web. Corona charging assembly 7 is energized by an AC voltage and generates AC corona current which discharges the insulating web. As drawn, the corona charging assembly 7 contains four separate corona chargers 13. Each charger 13 contains one corona discharge wire 14. The corona discharge wires 14 are connected to the power supply 6 via high voltage cables 3. Only the lower two high voltage wires are shown for clarity. The wires are routed through the shield and spacer assembly 5 to the power supply 6. The integral grounding tabs 4 of the shield and spacer assembly 5 are shown at each end of the assembly. The tabs are fastened to the power supply case and the grounded end plate of the charger assembly 7 using screws 8. The shield and spacer assembly 5 provides a grounded return for the current discharged from the corona wires 14 into the grounded members, the ground return follows a path that is essentially coaxial to the high voltage wires. This limits the loop area of the current path and thus reduces the efficiency of the loop to radiate undesired electromagnetic fields. The spacer prevents unwanted current flow between the high voltage cables 3 and the shield.

The preferred embodiment also employs multiple inner conductors 3. Multiple inner conductors 3 can be employed by keeping the voltage difference between the conductors 3 at a level that is not sufficient to generate corona discharge between the conductors 3. Additionally, the AC voltage within AC components is essentially equal and the frequency is preferably in phase between the AC components.

The present invention employs a pair of inner conductors 3 that are designed to pass 400 Hz trapezoidal waveforms carrying high voltages on the order of 5–6 kVrms. FIG. 3 shows the relative dimensions for the preferred embodiment of the invention. It will be understood by those skilled in the relevant arts that these dimensions can vary without departing from the spirit of the invention. A common reason for varying the dimensions seen in FIG. 3 is different voltages being employed within conductors 3. The operating voltages employed are a major factor in determining the thickness of the foam spacer 2, which may vary to provide sufficient distance between the inner conductors 3 and the shield 1 to prevent unintended current flow to the shield 1. Thicker foam spacers 2 would be desirable in embodiments having higher voltage applications. Based on the location of components within a system, the overall length and position of grounding tabs 4 can also vary.

The preferred embodiment uses Schlegel Silver $C^2$ conductive fabric for the shield 1. Metal conductors such as Alpha Tinned Copper Flat Braid Type 1235 are also effective as shield 1. The present invention utilizes a polyester foam tube for the spacer 2. Polyurethane foam tubes can also been utilized for spacer. The conductors 3 used by the preferred embodiment are made from insulated high voltage cables, specifically, silicon insulated UL Style 3239 wire.

The present invention results in a shield assembly that can be slipped over commonly available high voltage cables to provide electromagnetic interference shielding without significant current loss to the shield.

The foregoing description details the embodiments most preferred by the inventor, variations of these embodiments will be readily apparent to those skilled in the relevant arts, accordingly, the scope of the invention should be measured by the appended claims.

What is claimed is:

1. A corona charger comprising:

a high voltage conductor to transmit energy from a power supply to said corona charger;

a high frequency voltage, grounded conductive shield surrounding said high voltage conductor, said grounded conductive shield is formed from a conductive fabric having at least one grounding tab formed from said conductive fabric; and a foam spacer between said shield and said conductor.

2. The corona charger of claim 1, wherein said conductive fabric is heat-sealed around said spacer to form said grounded shield.

3. The corona charger of claim 1, wherein the conductive shield forms a path between said high voltage conductor and a power supply.

4. The corona charger of claim 1, wherein said foam spacer further comprises an insulating foam spacer wrapped around said high voltage conductor to form an insulating foam tube.

* * * * *